US010098378B2

(12) United States Patent
Rouillard et al.

(10) Patent No.: US 10,098,378 B2
(45) Date of Patent: Oct. 16, 2018

(54) TOBACCO MATERIAL CONTAINING NON-ISOMETRIC CALCIUM CARBONATE MICROPARTICLES

(76) Inventors: Stephane Rouillard, Brette-les-Pins (FR); Diane M. Raverdy-Lambert, Le Mans (FR); Christophe Rigoulay, Le Mans (FR); Johan Guitton, Le Mans (FR); Cedric Rousseau, Le Mans (FR)

( * ) Notice: Subject to any disclaimer, the term of this patent is extended or adjusted under 35 U.S.C. 154(b) by 1297 days.

(21) Appl. No.: 14/124,785

(22) PCT Filed: Jun. 8, 2012

(86) PCT No.: PCT/US2012/041463
§ 371 (c)(1),
(2), (4) Date: Apr. 25, 2014

(87) PCT Pub. No.: WO2012/170761
PCT Pub. Date: Dec. 13, 2012

(65) Prior Publication Data

US 2014/0224265 A1 Aug. 14, 2014

Related U.S. Application Data

(60) Provisional application No. 61/495,419, filed on Jun. 10, 2011.

(51) Int. Cl.
*A24B 15/28* (2006.01)
*A24B 15/12* (2006.01)
(Continued)

(52) U.S. Cl.
CPC ..... *A24B 15/287* (2013.01); *A24B 15/10* (2013.01); *A24B 15/12* (2013.01); *A24B 15/24* (2013.01); *A24B 15/285* (2013.01)

(58) Field of Classification Search
CPC ..... A24B 3/00; A24B 3/14; A24B 15/287; A24B 15/12; A24B 15/10; A24B 15/24; A24B 15/285; A24B 15/28
(Continued)

(56) References Cited

U.S. PATENT DOCUMENTS 3,353,541 A 11/1967 Hind et al.
3,386,449 A 6/1968 Hind
(Continued)

FOREIGN PATENT DOCUMENTS

CN 101683180 A 3/2010
EP 0419975 A2 3/1991
(Continued)

OTHER PUBLICATIONS

Chinese textbook published in Dec. 1987, 5 pages, https://vpn.hw.sipo/proxy*62932087/n/print.jsp dated Jun. 12, 2016.
(Continued)

*Primary Examiner* — Dennis R Cordray
(74) *Attorney, Agent, or Firm* — Dority & Manning, P.A.

(57) ABSTRACT

A smoking article formed from a tobacco material that includes tobacco non-isometric precipitated calcium carbonate microparticles is provided. The non-isometric microparticles typically have a mean diameter of from about 50 nanometers to about 3 micrometers, in some embodiments from about 80 nanometers to about 1 micrometer, in some embodiments from about 100 nanometers to about 400 nanometers, and in some embodiments, from about 200 nanometers to about 300 nanometers. Such non-isometric particles may have an elongated morphology so that the length of the microparticles is greater than the diameter. This may be characterized by the "aspect ratio" of the microparticles (length divided by width), which is typically from about 1 to about 15, in some embodiments from about 2 to
(Continued)

about 12, and in some embodiments, from about 3 to about 10. For example, the average length of the microparticles may range from about 100 nanometers to about 8 micrometers, in some embodiments from about 300 nanometers to about 5 micrometers, in some embodiments from about 500 nanometers to about 4 micrometers, and in some embodiments, from about 1 micrometer to about 3 micrometers.

12 Claims, 1 Drawing Sheet

(51) Int. Cl.
*A24B 15/10* (2006.01)
*A24B 15/24* (2006.01)

(58) Field of Classification Search
USPC ..... 131/290, 300, 347, 352, 353, 356, 357, 131/364, 365
See application file for complete search history.

(56) References Cited

U.S. PATENT DOCUMENTS

| | | | | |
|---|---|---|---|---|
| 3,415,253 | A | 12/1968 | Michels et al. | |
| 3,420,241 | A | 1/1969 | Hind et al. | |
| 3,428,053 | A | 2/1969 | Schoenbaum et al. | |
| 3,467,109 | A | 9/1969 | Block et al. | |
| 3,483,874 | A | 12/1969 | Hind | |
| 3,561,451 | A | 2/1971 | Jacin et al. | |
| 3,760,815 | A | 9/1973 | Deszyck | |
| 3,805,802 | A | 4/1974 | Hedge et al. | |
| 3,847,164 | A | 11/1974 | Mattina et al. | |
| 3,860,012 | A | 1/1975 | Selke | |
| 4,182,349 | A | 1/1980 | Selke | |
| 4,506,684 | A | 3/1985 | Keritsis | |
| 4,674,519 | A | 6/1987 | Keritsis et al. | |
| 5,056,537 | A | 10/1991 | Brown et al. | |
| 5,074,321 | A * | 12/1991 | Gentry | A24B 15/14 131/335 |
| 5,129,408 | A * | 7/1992 | Jakob | A24B 15/14 131/352 |
| 5,232,678 | A * | 8/1993 | Bleakley | C01F 11/183 423/268 |
| 5,377,698 | A | 1/1995 | Litzinger et al. | |
| 5,396,911 | A | 3/1995 | Casey, III et al. | |
| 5,715,844 | A | 2/1998 | Young et al. | |
| 5,724,998 | A | 3/1998 | Gellatly et al. | |
| 5,765,570 | A | 6/1998 | Litzinger et al. | |
| 6,251,222 | B1 | 6/2001 | Silenius et al. | |
| 7,398,783 | B2 | 7/2008 | Biggs et al. | |
| 2003/0041867 | A1 | 3/2003 | Hajaligol et al. | |
| 2006/0021626 | A1 | 2/2006 | Mua | |
| 2006/0174904 | A1 | 8/2006 | Wanna | |
| 2007/0034220 | A1 | 2/2007 | Pandolfino | |
| 2007/0287758 | A1 | 12/2007 | Ricaud et al. | |
| 2009/0068268 | A1 | 3/2009 | Bertelsen et al. | |
| 2009/0124745 | A1 | 5/2009 | Nover et al. | |
| 2009/0283104 | A1 | 11/2009 | Hampl, Jr. et al. | |
| 2010/0135891 | A1 * | 6/2010 | Hansen | C01F 11/18 423/432 |
| 2012/0312314 | A1 | 12/2012 | Plakidis et al. | |

FOREIGN PATENT DOCUMENTS

| | | | |
|---|---|---|---|
| GB | 1171878 | | 11/1969 |
| GB | 2469842 | A * | 11/2010 |

OTHER PUBLICATIONS

PCT/US2012/041463 International Search Report and Written Opinion, dated Sep. 10, 2012.
PCT/US2012/041463 International Search Report and Written Opinion, dated Dec. 10, 2013.
Article—GCC vs. PCC as the primary filler for uncoated and coated wood-free paper, M. Laufmann et al., pp. 1-14, Tappi Journal, May 2000, vol. 83 (5).
Chinese textbook; ISBN 978-7-122-01325-5; ordinary light and nano calcium carbonate Q, by Yan Xin, published by Chemical Industry Press, Jan. 2008, 5 pages.

* cited by examiner

TOBACCO MATERIAL CONTAINING NON-ISOMETRIC CALCIUM CARBONATE MICROPARTICLES

CROSS REFERENCE TO RELATED APPLICATION

This application is the national stage entry of International Patent Application No. PCT/EP2012/041463 having a filing date of Jan. 8, 2012, which claims the filing benefit of U.S. Provisional Application No. 61/495,419 having a filing date of Jun. 10, 2011 and which are both incorporated herein by reference.

BACKGROUND OF THE INVENTION

Smoking articles, such as cigarettes, are conventionally made by wrapping a column of tobacco in a wrapping paper. At one end, the smoking article usually includes a filter through which the article is smoked. Filters are attached to smoking articles using a tipping paper that is glued to the wrapping paper. When the article is smoked, mainstream smoke is generated that is inhaled through the filter. Mainstream smoke can contain numerous components that provide the smoking article with a particular taste, which encompasses the sensations detected not only by one's taste, but also by one's sense of smell.

Certain smoking components may, however, be unwanted in the mainstream smoke from a smoking article. As such, extensive research has been conducted on reducing Hoffmann analytes. U.S. Patent Publication No. 2003/0041867 to Hajaligol, et al., for instance, describes a tobacco smoking mixture that includes tobacco and a finely divided inorganic particulate material for reducing the temperature of a burning portion of the tobacco smoking mixture upon combustion/pyrolysis thereof. According to Hajaligol, et al., this reduction in temperature decreases the amount of high-temperature products (e.g., carbon monoxide, nitrogen oxides, and hydrocarbons) produced by the combustion/pyrolysis of the tobacco smoking mixture. Suitable inorganic materials are said to include, for instance, graphite, fullerene, carbon foam, graphitic foam, activated carbon, titanium oxide, aluminum oxide, calcium carbonate, and magnesium carbonate. The particles are preferably of a size less than 1 micrometer. While such finely divided inorganic particles might theoretically provide a greater degree of analyte reduction, they are nevertheless too small to be of practical use in most tobacco processes. On the other hand, large particles are generally not as effective.

As such, a need currently exists for an improved tobacco product that can be formed in an efficient and cost effective manner, and yet still exhibit a reduction of one or more Hoffman analytes in mainstream smoke produced by the product.

SUMMARY OF THE INVENTION

In accordance with one embodiment of the present invention, a smoking article is disclosed that comprises a tobacco material. The tobacco material comprises from about 5 wt. % to about 60 wt. % of precipitated calcium carbonate microparticles. The calcium carbonate microparticles are non-isometric, and have a mean diameter of from about 50 nanometers to about 3 micrometers and an aspect ratio of from about 1 to about 15.

In accordance with another embodiment of the present invention, a method for forming a tobacco material for use in a smoking article is disclosed. The method comprises combining tobacco with a solvent to form a soluble portion and an insoluble portion. The insoluble portion is contacted with precipitated calcium carbonate microparticles to form a tobacco material. The calcium carbonate microparticles are non-isometric, and have a mean diameter of from about 50 nanometers to about 3 micrometers and an aspect ratio of from about 1 to about 15.

Other features and aspects of the present invention are set forth in greater detail below.

BRIEF DESCRIPTION OF THE DRAWINGS

A full and enabling disclosure of the present invention, including the best mode thereof to one skilled in the art, is set forth more particularly in the remainder of the specification, including reference to the accompanying figures, in which.

Figure 1:
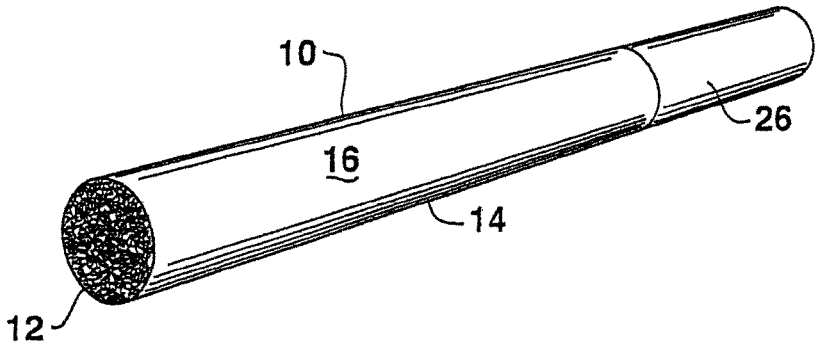
FIG. 1 is a perspective view of a smoking article made in accordance with the present invention.

Repeat use of reference characters in the present specification and drawings is intended to represent the same or analogous features or elements of the present invention.

DETAILED DESCRIPTION OF REPRESENTATIVE EMBODIMENTS

It is to be understood by one of ordinary skill in the art that the present discussion is a description of exemplary embodiments only, and is not intended as limiting the broader aspects of the present invention.

Generally speaking, the present invention is directed to a smoking article that is formed from a tobacco material that includes tobacco and an inorganic oxide filler. Of the myriad of different possible types and sizes of inorganic oxide fillers, the present inventors have surprisingly discovered that precipitated calcium carbonate microparticles can have a synergistic affect on the reduction of Hoffman analytes (e.g., tar, nicotine, and carbon monoxide) in the mainstream smoke produced by the article. As used herein, the term "precipitated" refers to calcium carbonate microparticles that have been synthesized using a variety of known processes. This is in contrast to "ground" calcium carbonate, which is naturally derived from limestone. The precipitated particles of the present invention are non-isometric and thus have varying dimensions. The non-isometric microparticles, for example, may have a mean diameter ("$d_P$") of from about 50 nanometers to about 3 micrometers, in some embodiments from about 80 nanometers to about 1 micrometer, in some embodiments from about 100 nanometers to about 400 nanometers, and in some embodiments, from about 150 nanometers to about 350 nanometers. For non-isometric particles, the mean diameter of the individual particles is the smallest dimension of the particles and may be measured using a variety of known techniques, such as the Lea-Nurse method (Standards NFX 11-601, 1974). The mean particle diameter ($d_P$) may be obtained from the massic area ($S_M$) derived from the Lea and Nurse method. The relationship between $d_P$ and $S_M$ may, in some cases, be determined as follows: $dp=6/(\rho S_M)$ where $\rho$ is the specific mass of the calcium carbonate, which is for example, 2.71 for calcite and 2.94 for aragonite. Such methods are also described in U.S. Patent Publication Nos. 2009/0124745 to Nover, et al. and 2007/0287758 to Ricaud, et al., which are incorporated herein in their entirety by reference thereto for all relevant purposes. The mean diameter may also be determined using electronic microscopy. In addition, the microparticles may have a $D_{50}$ particle diameter of from about 100 nanometers to about 8 micrometers, in some embodiments from about 300 nanometers to about 5 micrometers, in some embodiments from about 500 nanometers to about 4 micrometers, and in some embodiments, from about 1 micrometer to about 3 micrometers. The term "$D_{50}$" means that at least 50% of the particles have a diameter within the ranges noted.

The non-isometric microparticles generally possess an elongated morphology so that their largest dimension (length) is greater than the mean diameter. This may be characterized by the "aspect ratio" of the microparticles (length divided by width), which is typically from about 1 to about 15, in some embodiments from about 2 to about 12, and in some embodiments, from about 3 to about 10. For example, the average length of the microparticles may range from about 100 nanometers to about 8 micrometers, in some embodiments from about 300 nanometers to about 5 micrometers, in some embodiments from about 500 nanometers to about 4 micrometers, and in some embodiments, from about 1 micrometer to about 3 micrometers. Without intending to be limited by theory, it is believed that such elongated micro particles can achieve the benefits of small micro particles (e.g., higher surface area and narrow particle size distribution), but can also be better retained within a tobacco material due to their larger length. This can provide for a more homogeneous distribution of the microparticles throughout the tobacco material, which in turn allows the microparticles to be employed at higher amounts than would otherwise be possible with ground calcium carbonate. Among other things, this may enhance the degree to which the Hoffman analytes can be reduced. For example, the elongated calcium carbonate microparticles may constitute from about 5 wt. % to about 60 wt. % of the tobacco blend, in some embodiments from about 10 wt. % to about 50 wt. %, and in some embodiments, from about 20 wt. % to about 40 wt. %, while tobacco may constitute from about 40 wt. % to about 95 wt. % of the tobacco blend, in some embodiments from about 50 wt. % to about 90 wt. %, and in some embodiments, from about 60 wt. % to about 80 wt. % of the blend. As used herein, the term "tobacco" may encompass a variety of different tobacco forms, including stems, fines, reconstituted tobacco, expanded tobacco, tobacco extracts, blends thereof, and other tobacco-containing materials.

The non-isometric calcium carbonate microparticles may generally be synthesized using any precipitation technique known in the art. For example, the microparticles may be prepared by a synthetic precipitation reaction that involves contacting carbon dioxide with a solution of calcium hydroxide, the latter being most often provided on forming an aqueous suspension of calcium oxide, also known as burnt lime, and the suspension of which is commonly known as milk of lime. Depending on the reaction conditions, the resulting microparticles can appear in various forms, including both stable and unstable polymorphs. Indeed, precipitated calcium carbonate can often represent a thermodynamically unstable calcium carbonate material. Thus, when referred to in the context of the present invention, precipitated calcium carbonate may include synthetic calcium carbonate products obtained by carbonation of a slurry of calcium hydroxide, commonly referred to in the art as a slurry of lime or milk of lime when derived from finely divided calcium oxide particles in water. Of course, further additives, precipitation conditions, or steps prior to or following this precipitation may be implemented.

The calcium carbonate can be substantially amorphous or substantially crystalline. The term "substantially amorphous" or "substantially crystalline" is understood to mean that more than 50% by weight of the calcium carbonate is in the form of amorphous or crystalline material when analyzed by the X-ray diffraction technique. Substantially crystalline calcium carbonates are preferred. The calcium carbonate can be composed of calcite, of vaterite or of aragonite or of a mixture of at least two of these crystallographic varieties. The calcite variety is preferred. The crystalline morphology may also vary, such as scalenohedral or rhombohedral. The scalenohedral crystalline morphology is particularly suitable.

The elongated calcium carbonate microparticles typically have a high purity level, such as at least about 95 wt. %, in some embodiments at least about 98 wt. %, and in some embodiments, at least about 99 wt. %. Such high purity calcium carbonates are generally fine, and thus provide a more controlled and narrow particle size for improving the distribution of the microparticles within the tobacco blend. The microparticles may also exhibit a relatively high specific surface area. For example, the specific surface area may be about 2 square meters per gram ("$m^2/g$") or more, in some embodiments from about 3 $m^2/g$ to about 20 $m^2/g$, and in some embodiments, from about 4 $m^2/g$ to about 12 $m^2/g$. The "specific surface area" may be determined by the physical gas adsorption (B.E.T.) method of Bruanauer, Emmet, and Teller, Journal of American Chemical Society, Vol. 60, 1938, p. 309, with nitrogen as the adsorption gas (See also Standard ISO 9277, first edition, 1995-05-15). For example, specific surface area may be measured with an apparatus that measures the quantity of adsorbate nitrogen gas adsorbed on a solid surface by sensing the change in thermal conductivity of a flowing mixture of adsorbate and inert carrier gas (e.g., helium).

The precipitated calcium carbonate microparticles may optionally be coated with a modifier (e.g., fatty acid, such as stearic acid or behenic acid) to facilitate the free flow of the microparticles in bulk and their ease of dispersion into the tobacco blend. Nevertheless, in certain embodiments, it may be desired to use microparticles that are uncoated to minimize the extent to which the coating materials may undergo a reaction during smoking of the article.

The manner in which the non-isometric calcium carbonate microparticles are combined with tobacco to form a blend may vary as is known in the art. In one embodiment, for example, a tobacco furnish containing tobacco stems (e.g., flue-cured stems), fines and/or other tobacco by-products from tobacco manufacturing processes is initially mixed with a solvent (e.g., water and/or other compounds). Various solvents that are water-miscible, such as alcohols (e.g., ethanol), can be combined with water to form an aqueous solvent. The water content of the aqueous solvent can, in some instances, be greater than 50 wt. % of the solvent, and particularly greater than 90 wt. % of the solvent. Deionized water, distilled water or tap water may be employed. The amount of the solvent in the suspension can vary widely, but is generally added in an amount from about 50 wt. % to about 99 wt. %, in some embodiments from about 60 wt. % to about 95 wt. %, and in some embodiments, from about 75 wt. % to about 90 wt.% of the suspension. However, the amount of solvent can vary with the nature of the solvent, the temperature at which the extraction is to be carried out, and the type of tobacco furnish.

After forming the solvent/tobacco furnish mixture, some or all of a soluble portion of the furnish mixture may be optionally separated (e.g., extracted) from the mixture. The aqueous solvent/tobacco furnish mixture can be agitated during extraction by stirring, shaking or otherwise mixing the mixture in order to increase the rate of extraction. Typically, extraction is carried out for about one-half hour to about 6 hours. Extraction temperatures may range from about 10° C. to about 100° C. The soluble portion can optionally be concentrated using any known type of concentrator, such as a vacuum evaporator. If desired, the precipitated calcium carbonate microparticles may be mixed with the soluble portion, before, during, and/or after extraction from the furnish. The resulting blended soluble portion may be used alone as a tobacco product (e.g., flavoring material) or it may be subsequently combined with other materials to form the tobacco product. Likewise, it should also be understood that the precipitated calcium carbonate microparticles may be blended with the insoluble portion of the tobacco material.

In one embodiment, the soluble portion may be recombined with an insoluble portion (e.g., sheet, tobacco blend, insoluble residue, etc.) using various application methods, such as spraying, using sizing rollers, saturating, etc. For, the insoluble portion may be formed by the extracted solids portion described above, which may be subjected to one or more mechanical refiners to produce a fibrous pulp. Some examples of suitable refiners can include disc refiners, conical refiners, etc. The pulp from the refiner can then be transferred to a papermaking station (not shown) that includes a forming apparatus, which may include, for example, a forming wire, gravity drain, suction drain, felt press, Yankee dryer, drum dryers, etc. In such a forming apparatus, the pulp is laid onto a wire belt forming a sheet-like shape and excess water is removed by the gravity drain and suction drain and presses. Regardless, when recombined with an insoluble portion, the resulting tobacco product is generally known as "reconstituted tobacco." Reconstituted tobacco can generally be formed in a variety of ways. For instance, in one embodiment, band casting can be utilized to form the reconstituted tobacco. Band casting typically employs a slurry of finely divided tobacco parts and a binder that is coated onto a steel band and then dried. After drying, the sheet is blended with natural tobacco strips or shredded and used in various tobacco products, including as a cigarette filler. Some examples of process for producing reconstituted tobacco are described in U.S. Pat. Nos. 3,353,541; 3,420,241; 3,386,449; 3,760,815; and 4,674,519; which are incorporated herein in their entirety by reference thereto for all relevant purposes. Reconstituted tobacco can also be formed by a papermaking process. Some examples of processes for forming reconstituted tobacco according to this process are described in U.S. Pat. Nos. 3,428,053; 3,415,253; 3,561,451; 3,467,109; 3,483,874; 3,860,012; 3,847,164; 4,182,349; 5,715,844; 5,724,998; and 5,765,570; which are also incorporated herein in their entirety by reference thereto for all relevant purposes. For example, the formation of reconstituted tobacco using papermaking techniques can involve the steps of mixing tobacco with water, extracting the soluble ingredients therefrom, concentrating the soluble ingredients, refining the tobacco, forming a web, reapplying the concentrated soluble ingredients, drying, and threshing.

In addition, various other ingredients, such as flavor or color treatments, can also be applied to the web. If applied with the soluble portion and/or other ingredients, the fibrous sheet material can, in some embodiments, then be dried using, for example, a tunnel dryer, to provide a sheet having a typical moisture content of less than 20% by weight, and particularly from about 9% to about 14% by weight. Subsequently, the sheet can be cut to a desired size and/or shape and dried to the desired final moisture content.

Although various embodiments for incorporating precipitated calcium carbonate microparticles with tobacco have been described above, it should be understood that the microparticles can generally be contacted with tobacco in any manner desired. For example, in some embodiments, the microparticles can be added to a wet sheet as it is formed. It should also be understood that, if desired, the microparticles can be applied at more than one stage of a process.

As a result of the present invention, it has been discovered that the content of one or more Hoffman analytes (e.g., tar, nicotine, carbon monoxide, etc.) in tobacco smoke can be selectively reduced. For instance, it has been discovered that the total content of nicotine, carbon monoxide, and/or tar can be reduced at least about 20%, in some embodiments at least about 40%, and in some embodiments, between about 60% to about 100% from the initial total level when contacted with the precipitated calcium carbonate microparticles of the present invention.

Figure 2:
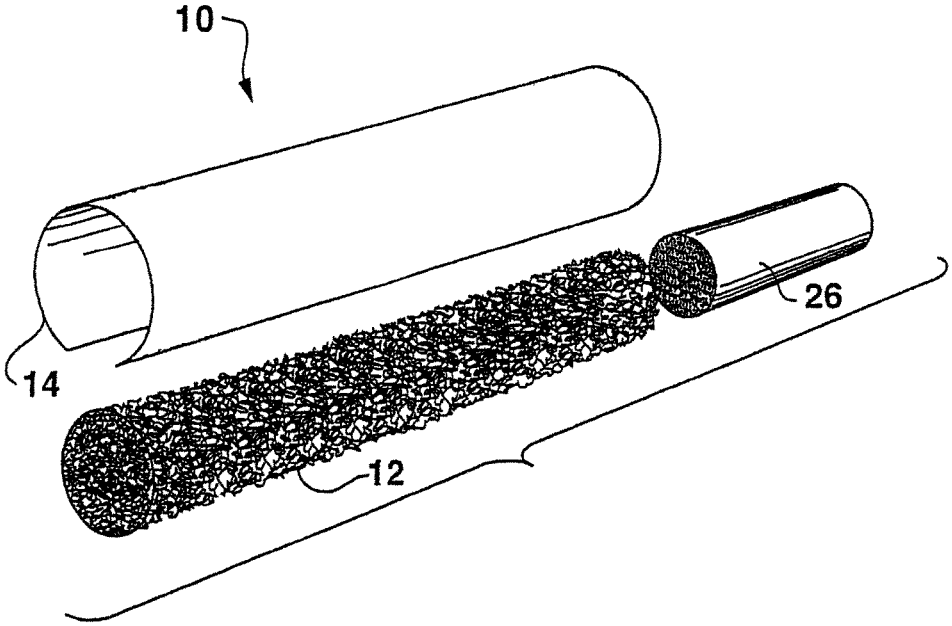
FIG. 2 is an exploded view of the smoking article illustrated in FIG. 1.

In addition, significantly improved tobacco products may be formed therefrom from tobacco in accordance with the present invention. As used herein, the term "tobacco product" is meant to encompass smoking articles (e.g., cigarettes, cigars, fine cut smoking articles, pipes, etc.), tobacco additives (e.g., for use as flavorants, etc.), etc. For example, when the tobacco generating a reduced level of Hoffman analytes is incorporated into a smoking article, smoke produced by the smoking article can also contain a lower content of such analytes. For illustrative purposes only, one such smoking article is shown in FIGS. 1-2. As shown, the smoking article 10 includes a tobacco column 12 that includes a blend of tobacco and precipitated calcium carbonate microparticles (not shown) in accordance with the present invention. The smoking article 10 may also include a wrapper 14 that defines an outer circumferential surface 16 when wrapped around the tobacco column 12. The article 10 may also include a filter 26 that may be enclosed by a tipping paper. The wrapper may be made from cellulosic fibers and a filler, as is well known in the art.

The present invention may be better understood by the following examples.

EXAMPLE 1

A mixture of threshed Burley stem (75%) and Virginia scraps (25%) was initially heated at 60° C. for 20 minutes with a tobacco/water ratio of 1 to 5 by weight. This was followed by an extraction step in a hydraulic press to separate the aqueous portion from the tobacco fiber portion. The recovered tobacco fiber portion was again heating at 60° C. for 10 minutes with a tobacco/water ratio of 1 to 5 by weight. After an additional extraction (by pressing), wood pulp was added to the tobacco fibrous residue. These samples were then refined in a Valley beater at 4% consistency for 55 minutes. The resultant stock was used to make hand sheets with the introduction (or not) of five (5) different calcium carbonates as follows:

Sample T: Control without filler

Sample A: 25% filler in finished product (scalenohedral precipitated calcium carbonate having a mean particle diameter of 290 nm (by permeability method) and a $D_{50}$ particle size of 2 μm);

Sample B: 25% filler in finished product (rosette-shaped precipitated calcium carbonate having an average particle size of 70 nm);

Sample C: 25% filler in finished product (ground calcium carbonate having a $D_{50}$ particle size of 0.9 μm);

Sample D: 25% filler in finished product (precipitated calcium carbonate having a mean particle size of 12 μm); and Sample E: 25% filler in finished product (ground calcium carbonate having a mean size of 12 μm and a $D_{50}$ particle size of 5.3 μm).

The aqueous portion was concentrated in an evaporator to a solid concentration of 50% and then coated on a hand sheet on a manual size-press.

The soluble level is typically between 27 and 37% in dy finished product. The coated hand sheets were dried on a plate dryer. The sheet was shredded formed into cigarettes with 50% from the shreds and 50% of a commercial American Blend. The cigarette length was 84 mm (tubes with a 28 mm butt length and 50 CORESTA paper porosity) and the circumference was 25 mm. The cigarette weight was approximately 990 milligrams. The cigarettes were smoked on a conventional machine at 1 puff per minute of 35 ml volume and 2 seconds duration. An analysis of the smoke for a variety of composition of the reconstituted tobacco gave the following results for tar, carbon monoxide, and formaldehyde:

| | Filler % | Pressure drop in cigarette (mm water gauge |
|---|---|---|
| T | — | 72 |
| A | 22.6 | 95 |
| B | 26 | 91 |
| C | 23.5 | 90 |
| D | 20.5 | 74 |
| E | 17.5 | 76 |

EXAMPLE 2

A mixture of threshed (Burley & Virginia) stem (55%), Virginia scraps (36%) and wood pulp (9%) was heated at 65° C. with a tobacco/water ratio of 1 to 5 by weight. This was followed by pressing to separate the fibrous portion from the aqueous portion. The fibrous portion was then passed through a refiner. The resultant stock was diluted and fed together with precipitated calcium carbonate (2 μm or 12 μm) to the headbox of a conventional paper-making machine. A continuous sheet was produced. Two series of two samples of reconstituted tobacco (one control without calcium carbonate and one trial sample) were thus prepared. In the series "F", a 20% concentration of a 2 μm precipitated calcium carbonate was used. In the series "G", a 30% concentration of a 12 μm precipitated calcium carbonate was used. For each series, the sheet material was impregnated with concentrated aqueous tobacco soluble extracted in the pressing stage. The final soluble level in dry finished product is typically between 27 and 44%.

The sheet was shredded formed into cigarettes with 50% from the shreds and 50% of a commercial American Blend. The cigarette length was 84 mm (tubes with a 28 mm butt length and 50 CORESTA paper porosity) and the circumference was 25 mm. The cigarette weight was approximately 990 milligrams. The cigarettes were smoked on a conventional smoking machine at 1 puff per minute of 35 ml volume and 2 seconds duration. An analysis of the smoke for a variety of composition of the reconstituted tobacco gave the following results for tar, carbon monoxide, and formaldehyde:

| | Filler % | Pressure drop in cigarette (mm water gauge) |
|---|---|---|
| T1 | — | 98 |
| F | 18.7 | 117 |
| T2 | — | — |
| G | 29.6 | — |

| | Tar | | | Carbon monoxide | | | Formaldehyde | | |
|---|---|---|---|---|---|---|---|---|---|
| | Per cigarette in mg | Reduction (% vs T) | Dilution effect* | Per cigarette in mg | Reduction (% vs T) | Dilution effect* | Per cigarette in μg | Reduction (% vs T) | Dilution effect* |
| T | 10.5 | — | — | 16.5 | — | — | 82 | — | — |
| A | 7.8 | 22.6 | −2.3 | 12.0 | 28 | −2.5 | 36 | 56% | −4.9 |
| B | 7.4 | 26.0 | −2.3 | 11.9 | 28 | −2.1 | 31 | 62% | −4.8 |
| C | 7.8 | 23.5 | −2.1 | 12.0 | 27 | −2.3 | 36 | 56% | −4.7 |
| D | 9.3 | 17.8 | −1.3 | 12.7 | 23 | −2.6 | 51 | 37% | −4.1 |
| E | 9.2 | 20.5 | −1.2 | 13.3 | 20 | −1.9 | 50 | 39% | −3.8 |

*Dilution effect = reduction/filler level in cigarette (which is half of the filler level in the reconstituted tobacco). That is, introduction of 1 point of the reconstituted tobacco will induce a reduction of 2.3 points of tar in the cigarette.

| | Tar | | | Carbon monoxide | | | Formaldehyde | | |
|---|---|---|---|---|---|---|---|---|---|
| | Per cigarette in mg | Reduction (% vs T) | Dilution effect* | Per cigarette in mg | Reduction (% vs T) | Dilution effect* | Per cigarette in μg | Reduction (% vs T) | Dilution effect* |
| T1 | 10.9 | — | — | 15.1 | — | — | 44.4 | — | — |
| F | 7.2 | 34% | −4 | 11.6 | 23% | −2.7 | 23.9 | 46.2% | −5.4 |
| T2 | 10.7 | — | — | 13.9 | — | — | 47 | — | — |
| G | 8.8 | 17% | −1.3 | 10.8 | 22% | −1.6 | 37 | 21% | −1.5 |

*Dilution effect = reduction/filler level in cigarette (which is half of the filler level in the reconstituted tobacco). That is, introduction of 1 point of the reconstituted tobacco will induce a reduction of 2.3 points of tar in the cigarette.

These and other modifications and variations of the present invention may be practiced by those of ordinary skill in the art, without departing from the spirit and scope of the present invention. In addition, it should be understood that aspects of the various embodiments may be interchanged both in whole or in part. Furthermore, those of ordinary skill in the art will appreciate that the foregoing description is by way of example only, and is not intended to limit the invention so further described in such appended claims.

What is claimed is:

1. A smoking article that comprises a tobacco material, wherein the tobacco material comprises from about 5 wt. % to about 60 wt. % of precipitated calcium carbonate microparticles, wherein the calcium carbonate microparticles are uncoated, wherein the calcium carbonate microparticles are non-isometric, the microparticles being described by a mean diameter and an aspect ratio of length to mean diameter, wherein the microparticles possess a mean diameter of from about 50 nanometers to about 3 micrometers and an aspect ratio of from about 2 to about 12.

2. The smoking article of claim 1, wherein the calcium carbonate microparticles have a mean diameter of from about 100 nanometers to about 400 nanometers.

3. The smoking article of claim 1, wherein the calcium carbonate microparticles have an average length of from about 100 nanometers to about 8 micrometers.

4. The smoking article of claim 1, wherein the calcium carbonate microparticles have an average length of from about 500 nanometers to about 4 micrometers.

5. The smoking article of claim 1, wherein the calcium carbonate microparticles have an aspect ratio of from about 3 to about 10.

6. The smoking article of claim 1, wherein the calcium carbonate microparticles constitute from about 10 wt. % to about 50 wt. % of the tobacco material.

7. The smoking article of claim 1, wherein tobacco constitutes from about 40 wt. % to about 95 wt. % of the tobacco material.

8. The smoking article of claim 1, wherein the calcium carbonate microparticles are homogenously distributed throughout the tobacco material.

9. The smoking article of claim 1, wherein the calcium carbonate microparticles have a scalenohedral crystalline morphology.

10. The smoking article of claim 1, wherein the calcium carbonate microparticles have a specific surface area of from about 3 m2/g to about 20 m2/g.

11. The smoking art cle of claim 1, wherein the tobacco material includes reconstituted tobacco.

12. The smoking article of claim 1, wherein the tobacco material is shaped into a column, and wherein a wrapper surrounds the column.

* * * * *